US006346215B1

(12) United States Patent
Boegel et al.

(10) Patent No.: US 6,346,215 B1
(45) Date of Patent: Feb. 12, 2002

(54) COPPER-TIN ALLOYS AND USES THEREOF

(75) Inventors: Andreas Boegel, Weissenhorn; Stephan Hansmann, Ulm; Uwe Hofmann, Neu-Ulm; Hilmar R. Mueller, Bellenberg; Joachim Riedle, Bad Wurzach, all of (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 09/595,289

(22) Filed: Jun. 15, 2000

Related U.S. Application Data

(63) Continuation-in-part of application No. 09/212,524, filed on Dec. 16, 1998, now Pat. No. 6,136,103.

(30) Foreign Application Priority Data

| | | |
|---|---|---|
| Dec. 19, 1997 | (DE) | 197 56 815 |
| Jun. 15, 1999 | (DE) | 199 27 136 |
| Jun. 15, 1999 | (DE) | 199 27 137 |
| Jun. 17, 1999 | (DE) | 199 27 646 |
| Jun. 21, 1999 | (DE) | 199 28 330 |

(51) Int. Cl.[7] ..... C22C 9/02
(52) U.S. Cl. ..... 420/470; 420/473; 148/433
(58) Field of Search ..... 420/473, 470; 148/412, 433

(56) References Cited

U.S. PATENT DOCUMENTS

| | | | | |
|---|---|---|---|---|
| 2,128,954 A | | 9/1938 | Montgomery | |
| 2,210,670 A | | 8/1940 | Kelly | |
| 3,615,373 A | | 10/1971 | Bangert | |
| 3,655,367 A | | 4/1972 | Bleecker et al. | |
| 3,923,558 A | * | 12/1975 | Shapiro et al. | 148/412 |
| 4,116,686 A | | 9/1978 | Mravic et al. | |
| 4,732,625 A | | 3/1988 | Livak | |
| 5,004,581 A | | 4/1991 | Takagi et al. | |
| 5,021,105 A | * | 6/1991 | Asai et al. | 148/433 |
| 5,028,282 A | * | 7/1991 | Kubozono et al. | 148/412 |
| 5,102,621 A | | 4/1992 | Sara | |
| 5,820,701 A | * | 10/1998 | Bhargava | 148/433 |

FOREIGN PATENT DOCUMENTS

| | | | |
|---|---|---|---|
| DE | 623 845 | | 1/1936 |
| DE | 1 189 725 | | 3/1962 |
| DE | 14 58 340 | | 11/1968 |
| DE | 27 20 461 | | 12/1977 |
| DE | 36 01 338 | | 6/1987 |
| DE | 41 26 079 | | 2/1993 |
| DE | 42 01 065 | | 7/1993 |
| EP | 225 732 | | 6/1987 |
| GB | 1 002 966 | | 9/1965 |
| GB | 1 096 220 | | 12/1967 |
| GB | 1 379 261 | | 1/1975 |
| GB | 1 496 749 | | 12/1977 |
| GB | 1 542 181 | | 3/1979 |
| GB | 1 599 392 | | 9/1981 |
| GB | 2 179 673 | | 3/1987 |
| JP | 356005942 A | * | 1/1981 |
| JP | 63-038544 | | 2/1988 |
| JP | 63-038545 | | 2/1988 |
| JP | 63-235455 | | 9/1988 |
| JP | 363266052 A | * | 11/1988 |
| JP | 04-017635 | | 1/1992 |
| JP | 06-088156 | | 3/1994 |
| WO | 87/02285 | | 4/1987 |

OTHER PUBLICATIONS

Kupfer und Kupferlegierungen in der Technik by Kurt Dies; 1967 pp. 504–505, 514–517, and 548–549.

* cited by examiner

*Primary Examiner*—Deborah Yee
(74) *Attorney, Agent, or Firm*—Flynn, Thiel, Boutell & Tanis, P.C.

(57) ABSTRACT

A copper alloy contains from 4 to 20 wt. % tin and various other metals. The alloys can be used in the manufacture of structural parts which are joined together through the use of heat such as jewelry, clothing accessories and mechanically stressed structural parts in a general machine-building or automotive industry. Iron, titanium, zirconium, hafnium, manganese, zinc, phosphorus and lead can also be present in the alloy composition.

25 Claims, No Drawings

COPPER-TIN ALLOYS AND USES THEREOF

This application is a continuation-in-part of Ser. No. 09/212,524 filed Dec. 16, 1998, now is U.S. Pat. No. 6,136,103 issued Oct. 24, 2000.

FIELD OF THE INVENTION

The present invention is directed to copper-tin alloys which are especially suitable for use in the manufacture of structural parts which are joined together through the use of heat.

BACKGROUND OF THE INVENTION

Copper-tin alloys have, due to their high mechanical strength and great resistance to sliding stress or wear and corrosion, been utilized for many different mechanical structural parts and preformed articles that are to be manufactured into semifinished products by mechanical working. Copper-tin alloys also have been used as casting materials and as wrought materials. Phosphor bronzes are also widely used due to their ready availability and low cost and have the physical properties of a high mechanical strength and ductility. Additionally, they offer a high corrosion resistance in many different environments.

Workable copper-tin materials are particularly attractive for use in the manufacture of structural parts having small dimensions and complicated geometries. For example, in DIN 17662, a wide variety of uses for 4 to 8% bronze is disclosed, which in addition to up to 8.5% tin, also contains phosphorus in an amount of from 0.01 to 0.35%, iron in an amount of up to 0.1%, nickel in an amount of up to 0.3%, zinc in an amount of up to 0.3% and lead in an amount of up to 0.05%. Improvements in these materials have been desired with respect to electrical conductivity and suitability for electromechanical structural parts.

WO 9/20176 and WO 98/48068 are concerned with the improvement of electrical conductivity and relaxation resistance of traditional copper-tin materials. However, these improvements have little bearing on the suitability of the use of copper-tin alloys in machine- and apparatus-building industries, and precision-mechanics and jewelry industries. In these particular industries, classic phosphorus-bronzes are still exclusively used due to the fact that these materials can be used in a wide variety of manners due to the characteristics which are obtained through cold-working. However, these classic phosphorus-bronzes also have their deficiencies.

Due to the manufacture of functional parts, it is often necessary to join different structural elements. Welding and hard soldering methods are typically utilized to join these structural elements or parts. However, due to the heat entering into the structural parts to be joined, losses in strength result in the parts of the metal exposed to the heat due to conservation and recrystalization. This is especially true when using fusion-welding and hard-soldering methods. In order to keep the loss in strength as small as possible, hard-soldering instead of welding is used as often as possible. With solders having operating temperatures typically starting at about 450° C., the joining of the structural elements can be performed but this requires a compromise between high strength and good loading capacity.

Since solder serves as a filler metal, the strength of the solder plays a role in the mechanical stability of the joined structure. As such, high strength solders are desirable. However, high strength solders, as a rule, have higher melting temperatures. This results in an increase in the heat applied to the joined parts and an attendant loss in strength in the areas adjacent the soldered junction. As such, there is a need for materials which resist softening during soldering operations.

In the eyeglass industry, nickel-free materials have been developed as materials having a higher resistance to softening. Many different copper-aluminum and copper-titanium alloys have been formulated. These alloys offer better spring characteristics and resistance to softening than phosphor bronze alloys typically utilized for the bows of glasses. However, during the use of these nickel-free alloys, it has been found that hard soldering under a protective gas creates problems in that these materials also react with an oxygen-deficient atmosphere and thereby significantly hinder the wetability of the surfaces of the structural part with the solder. Good processability during hard soldering is only possible through the use of aggressive flux agents. However, these aggressive flux agents have problems with respect to work safety and environmental contamination and also may cause a color change and leave residues on the joined structural parts. This requires that cleaning be performed in utilities where appearance is important. Moreover, independent of the flux agent, copper-tin alloys also have a tendency to change color during heating which also requires a cleaning of the joined structural parts. These cleaning operations are expensive and highly undesirable.

As discussed above, copper-tin wrought alloys containing about 8 wt. % tin are easily formed and especially suitable for the manufacture of complex functional parts. These alloys are used as friction bearings and gearings, springs and for parts which are stressed by ocean water, such as chains, armatures, etc. When utilized as structural parts which are subjected to very high mechanical stresses, such as gears, copper-tin cast alloys with tin contents above 10% by weight are preferred. These cast bronzes are increased in mechanical strength through the increased tin content. However, the increased tin-content results in brittle phases being formed in the primary structure during the solidification in common casting. These phases are not removed, even through a thermal after-treatment, without pores or imperfections remaining in the materials, which also in turn influence reforming.

Therefore, there exists a need for material which combines the chemical and mechanical characteristics of casting bronzes with the processing characteristics of wrought materials having a cold-working ability and guarantee of a high mechanical strength and hardness. In order to meet this need, an alloy has been proposed which is a copper-tin alloy containing tin in an amount of from 12 to 20 wt. % to enhance the strength of the material with the remainder being copper. This alloy can be formed by spray compacting or band casting and then quickly cooled from the molten state to suppress precipitation. This results in the primary structure of the alloy at room temperature being free of microscopic precipitation and the preforms manufactured from these alloys can be hot or cold formed in an excellent manner.

Even though the copper-tin alloy disclosed above has advantageous properties, deficiencies still remain with the alloy. As in a case of conventional low tin content copper-tin wrought alloys, there is a need to deoxidize the melt. Elements having an affinity for oxygen, such as phosphorus, are added to the melt as with conventional alloys. Due to the high affinity for oxygen, these added elements have a tendency to burn off and form slag during melting and casting which requires a complicated post treatment in order to maintain the desired concentrations. Additionally, the oxides of the deoxidation media influences the melt in general and the melt viscosity in particular and thus can have an influence on the forming process, such as spray compacting. Oxides from the oxygen affinity added mixtures can also be created during the hot-forming of the copper-tin alloys and these oxides worsen the surface quality of the formed goods and result in contamination of the tool and shortens the life of the tool. The presence of these oxides in the formed material are also undesirable during cutting or chipping since, due to their hardness, they contribute to an increased wear of the tool.

As such, there is a need for materials, which are at least equal to the high tin content copper-tin alloys in mechanical strength, formability and corrosion resistance and yet can be handled in a simplified manner during manufacture and processing. There also is a need for materials, which on the one hand meet the requirements regarding strength and softening characteristics for alloys used in the manufacture of components which are joined by a heat treatment and yet offer the advantages of hard-solderable tin-bronzes.

SUMMARY OF THE INVENTION

It is an object of the present invention to provide a copper-tin alloy having a mechanical strength, formability and corrosion resistance at least equal to that of high tin content copper-tin alloys and yet can be handled in a simplified manner during manufacture and processing.

It is a second object of the present invention to provide a copper-tin alloy which has the strength and softening characteristics necessary for it to be used in the manufacture of component parts which are joined together by heat and yet offer the advantages of hard-solderable tin-bronzes.

These and other objects of the present invention are accomplished by providing a copper alloy comprising from 4 to 20 wt. % tin, 0.1 to 5 wt. % in total of at least one of iron and cobalt, other optional metals, and the balance being copper. The present invention also is directed to a method of manufacturing structural parts which are joined together through the use of heat and in which at least one of the structural parts is made of a copper alloy comprising from 4 to 20 wt. % tin, 0.1 to 5 wt. % in total of at least one of iron and cobalt, other optional metals, and the balance being copper.

Another aspect of the present invention provides a copper-tin alloy having a tin content of from 12–20% and an iron content of from 0.2 to 5% which can be used in the manufacture of mechanical structural parts of the machine-building or automotive industry.

Still another aspect of the present invention is directed to a copper-tin alloy containing 4 to 12 wt.% tin, 0.1 to 4 wt. % iron and 0.01 to 0.6 wt. % titanium.

These and other aspects of the present invention will be explained in more detail in the following discussion.

DETAILED DISCUSSION

The copper-tin alloy, in one embodiment of the present invention, contains from 4 to 12 wt. % tin, 0.1 to 4 wt. % iron and 0.01 to 0.6 wt. % titanium, with the balance being copper. This alloy composition has a particularly high strength and resistance to softening. A particularly advantageous alloy composition results from alloying the titanium in a mass ratio of iron to titanium $\geqq 2.5$. Since titanium is an alloy element which easily reacts with oxygen in the presence of heat to form oxides which result in coatings which drastically reduce the wetability with molten solders, it is unexpectedly surprising that the addition of titanium would be favorable. That is, it has been shown that a copper-tin alloy containing 4 to 12 wt. % tin and 0.05 wt. % titanium has dramatically lower solder wetability. The soldering process can only be successfully performed with the aid of fluxing agents. However, when titanium is added in the ratio of the invention with iron to the alloy of the present invention, the soldering ability is not affected and the softening characteristics of the alloy is unexpectedly improved. The addition of titanium results in a significant delay in the onset of softening which results in decreased reproducibility in industrial hard-soldering operations and optimization of the mechanical strength of a soldered joint.

The titanium can be partially or totally replaced in the alloy by zirconium and hafnium and not adversely affect the alloys' properties. Additionally, to reduce the cost of the alloy, copper can be partially replaced with at least one of manganese and zirconium. However, no more than 10% by weight copper should be replaced by these metals since a greater replacement amount makes the casting ability more difficult and clearly lessens the good corrosion characteristics of the alloy of the present invention. Phosphorus should not be added to the copper-tin alloys of the present invention when titanium is present. The addition of phosphorus when titanium is present in the alloy composition results in the production of needle-shaped titanium phosphides in the molten alloy which makes the semifinished product manufacture process very difficult and is detrimental to the overall mechanical characteristics of the alloy.

In another embodiment of the present invention, the copper-tin alloy contains from 4 to 12 wt. % tin and 0.1 to 4 wt. % iron. Phosphorus also can be present in the inventive alloy in an amount of up to 0.5 wt.%. Phosphorus causes a moderate increase in the mechanical strength of the alloy after cold-working. Whenever it is considered that deoxidation is necessary, a phosphorus content of at least 0.01 wt. % should be used. However, phosphorus in an amount above 0.5 wt. % should be avoided since scales produced during soldering operations in an oxygen-containing atmosphere have a tendency to break off. Moreover, high phosphorus concentrations reduce the ductility of the alloys. Additionally, in the presence of iron, high phosphorus contents lead to the formation of rough iron phosphide particles which may interfere with the building of the structure. Therefore, phosphorus should be present in a mass ratio of iron to phosphorus of 2/1 in order to insure a favorable structure of the alloy through freely precipitating iron. In order to reduce the cost of the alloy, the copper can be partially replaced by at least one of manganese and zirconium. However, no more than 10% by weight of copper should be replaced by these metals in order to avoid a deterioration in the casting ability and corrosion resistance characteristics of the alloy.

A semifinished product manufactured out of the alloy of the second embodiment of the present invention can be easily handled without any problems during the manufacture thereof through conventional forming and reforming processes. Additionally, the alloy has excellent hard-soldering characteristics with many different solders and no oxides are produced on the surface of the alloy which would cause a poor wetting ability or a poor solder flow. As such, this alloy is particularly suitable for use in the manufacture of structural parts which are joined by heat such as jewelry, clothing accessories and components of eyeglass frames.

In another aspect of the present invention, the copper-tin alloy contains tin in an amount of from 12 to 20 wt. % and iron in an amount of from 0.1 to 4 wt.%. This alloy is also particularly suitable for use in the manufacture of structural parts which are to be joined through the use of heat. The high tin content and presence of iron gives the inventive alloys a particularly high strength and resistance to softening and a deoxidation aid, such as phosphorus, is not necessary although phosphorus can be added in an amount of up to approximately 0.5 wt.%.

This alloy is preferably formed by a casting method in which the creation of brittle phases is suppressed by rapid cooling from the molten state. These high cooling-off rates are achieved by band casting or spray compacting. Preforms of the alloys of the present invention manufactured by these methods are distinguished by having even, precipitation-poor primary structures. This structural state provides for a high mechanical strength and workability which enables the preforms to be processed without any problems by conventional forming methods. Additionally, the alloy has excellent hard-solderability properties with many different types of solders but does not have the problem of oxides forming on the surface which would cause a poor wetability and solder flow.

In a further embodiment of the present invention, the copper-tin alloy contains tin in an amount of from 12 to 20 wt. % and iron in an amount of from 0.2 to 5 wt. %. In order to achieve a good formability of these alloys, the original forming of the alloy should occur by a casting method in which the creation of brittle phases is avoided by a high cooling rate. It is surprising that during the casting of the alloy of the present invention by such a method, complicated vacuum or protective gas techniques are essentially not required. These alloys are characterized by a high strength or hardness, high resistance to creeping or softening and a high resistance to wear and, on the other hand, still possess a sufficiently high ductility which enables them to be changed in form by cold-forming by a degree of more than 20%. Iron can be partially or completely replaced in this alloy composition with cobalt. Manganese and/or zinc in an amount of up to 5% by weight can also be added to the alloy.

The chipping characteristics of the alloy can be adjusted by the addition of lead or graphite in an amount of up to 3 volume %. The addition of lead or graphite also can provide for improved characteristics in friction or sliding-stressed structural parts. However, the lead or graphite content is limited to 3% by volume in order to avoid negative effects on the forming properties of the alloy. Aluminum in an amount of up to 2.5% by weight can be added to further increase the mechanical strength of the alloy. Higher contents of aluminum are not practical since they adversely influence the surface treatment or subsequent joining of the alloy. Nickel also can be present in the alloy of the present invention in an amount of up to 5% by weight in order to improve the mechanical strength and corrosion resistance of the alloy. However, the addition of nickel in amounts above 5% by weight adversely affect the processability of the alloy by increasing its hardness.

Depending on how the inventive alloy is manufactured, phosphorus can be utilized for the deoxidation of the melt. The phosphorus exhibits a significant effect starting with 0.01 wt. % but to avoid iron-phosphide particles in the alloy structure, the phosphorus content is adjusted to the iron concentration such that the iron content/phosphorus content is greater than 2 and the phosphorus content in the alloy is not above 0.5 wt. % to avoid the reduction of the ductility of the material and the production of the loose adhering layers of scale during the heat processing.

The present invention is further shown through the following examples.

EXAMPLE 1

The alloys were manufactured according to the following process steps into metal strips having a 1 mm thickness.

Permanent mold castings of blocks

Homogenization at 700° C./6 h,

Hot rolling at 760° C. of the overmilled cast blocks with a reduction in cross section of 45%.

Cold rolling of the overmilled hot-rolled strips with a change in cross section of 50% based on the cross section of the overmilled hot-rolled strips Annealing treatment at 500° C./4 h, Finish rolling to 1 mm with a change in cross section of 75% based on the cross section according to the first cold working.

The compositions of the strips are shown below:

TABLE 1

| Alloy | Cu/% | Sn/% | Fe/% | Ti/% | P/% | Al/% |
|---|---|---|---|---|---|---|
| 1 | 91.37 | 8.57 | | 0.03 | | |
| 2 | 91.11 | 8.55 | 0.30 | | | |
| 3 | 91.08 | 8.22 | 0.66 | | | |
| 4* | 91.20 | 8.05 | 0.64 | 0.074 | | |
| 5* | 90.60 | 8.47 | 0.64 | 0.244 | | |
| 6 | 90.44 | 8.53 | 0.64 | 0.358 | | |
| 7* | 89.10 | 8.74 | 1.73 | 0.387 | | |
| 8 | 90.87 | 8.61 | 0.31 | | 0.1724 | |
| 9 | 91.09 | 8.58 | | | | 0.2862 |
| 10 | 90.89 | 8.49 | 0.31 | | | 0.2739 |
| 11 | 90.02 | 8.61 | 1.04 | | | 0.2821 |
| 12 | 91.90 | 8.06 | | | 0.024 | |

(*Alloy according to the invention; difference to 100%; each having unavoidable contaminants)

The results of the drawing tests, which were carried out on the finish-rolled strips, are shown in the following table.

TABLE 2

| Alloy | $R_{p0,2}$/Mpa | $R_m$/Mpa | $R_{p0,2}/R_m$ | $A_{10}$/% |
|---|---|---|---|---|
| 1 | 843 | 872 | 0.97 | 3.3 |
| 2 | 882 | 907 | 0.97 | 2.6 |
| 3 | 837 | 895 | 0.94 | 2.3 |
| 4* | 849 | 890 | 0.95 | 2.1 |
| 5* | 824 | 909 | 0.90 | 3.1 |
| 6 | 825 | 914 | 0.90 | 3.6 |
| 7* | 837 | 937 | 0.89 | 3.9 |
| 8 | 923 | 953 | 0.97 | 3.3 |
| 9 | 873 | 906 | 0.96 | 3.8 |
| 10 | 874 | 912 | 0.96 | 3.5 |
| 11 | 888 | 919 | 0.97 | 2.3 |
| 12 | 828 | 895 | 0.93 | 2.4 |

The measured values for the breaking tension $A_{10}$ and the stretch-limit ratio $R_{pO,2}/R_m$ which were found in the alloys of the invention, well agree with the respective values, which one obtains with the corresponding processing steps for the alloy 12 deoxidized with P. Since one may conclude from the amount of the breaking tension the effectiveness of the deoxidation, one can gather that Fe and Ti positively influence the creative forming of CuSn-alloys in the same manner as P.

To characterize the soldering behavior, 2 band strips of the same alloy were hard-soldered after their surfaces were degreased and mechanically cleaned. A commercially available silver solder was used with an operating temperature of 710° C. Soldering took place under a protective gas without the aid of a fluxing agent. The result of the soldering was evaluated both through a mechanical torsion test and also through a metallographic expert opinion. The strength of the joined materials in the direct vicinity of the soldering gap—thus in the heat-influence zone (WEZ)—was characterized by the Vickers-Hardness HV. The following table gives information about the obtained results.

TABLE 3

| Alloy | Hardness HV of Base Material | Lowest Hardness in WEZ after hard soldering | Structure in WEZ and Base Material | Quality Hard Soldering |
|---|---|---|---|---|
| 1 | 263 | 84 | Okay | Moderate |
| 2 | 273 | 95 | Okay | Good |
| 3 | 267 | 111 | Okay | Good |
| 4* | 267 | 115 | Okay | Good |
| 5* | 279 | 111 | Okay | Good |

TABLE 3-continued

| Alloy | Hardness HV of Base Material | Lowest Hardness in WEZ after hard soldering | Structure in WEZ and Base Material | Quality Hard Soldering |
|---|---|---|---|---|
| 6 | 276 | 129 | Rough particles over 10 μm | Not Useable |
| 7* | 284 | 151 | Okay | Good |
| 8 | 276 | 112 | Okay | Moderate |
| 9 | 273 | 87 | Okay | Not Useable |
| 10 | 274 | 103 | Okay | Not Useable |
| 11 | 279 | 121 | Okay | Not Useable |
| 12 | 275 | 81 | Okay | Good |

(*Alloy of the invention; WEZ: Heat-Influence Zone)

The results prove the extremely favorable effect of iron on the residual hardness after the soldering. It becomes clear that when not maintaining the inventive FeTi-relationship an improved softening resistance, but not a good hard-soldering ability, exists (alloys 1 and 6, in comparison to conventional alloy formulation 12).

To check the material softening during soldering, sections of the cold-formed band sections were annealed at 700° C. up to 5 min in a salt bath and the residual hardness HV was measured after various times t to obtain the isothermal softening characteristic HV(t) of the analyzed material. The course of hardness over time is important for judging the strength after soldering and the safety in the industrial manufacture of joined structural parts. The higher the residual hardness HV (300 s) after a five-minute annealing treatment, the higher is the to be expected mechanical stability of the soldered connection. The smaller the change in the hardness over time, the more even is the quality of the joined structural parts, and the more robust is the manufacturing process against unavoidable fluctuations of the process parameters. Thus, what was evaluated was on the one hand the height of the residual hardness of the alloy Y (Y=1.2 . . . 12) after a five-minute annealing treatment in relationship to the common phosphorus bronze alloy 12: HV(Y, 700° C., 300 s)/HV(12, 700° C., 300 s)−1. On the other hand, the alloys Y were compared with the alloy 12 with respect to the reduction of the difference between the hardness after 60 s and 300 s: 1 −[HV(Y, 700° C., 60 s)−HV(Y, 700° C., 300 s)]/[HV(12, 700° C., 60 s)−HV(12, 700° C., 300s)]. Good materials by comparison show particularly good, positive values for both evaluations.

TABLE 4

| Alloy | Initial Hardness HV | Hardness HV after 60 s | Hardness HV after 180 s | Hardness HV after 300 s | Residual Hardness HV (300 s) in comparison to alloy 12 | Reduction of hardness drop from 60 to 300 s compared to alloy 12 |
|---|---|---|---|---|---|---|
| 1 | 263 | 83 | 84 | 79 | 8% | 75% |
| 2 | 273 | 90 | 79 | 79 | 8% | 31% |
| 3 | 267 | 118 | 108 | 108 | 48% | 38% |
| 4* | 267 | 112 | 107 | 107 | 47% | 69% |
| 5* | 279 | 123 | 118 | 117 | 60% | 63% |
| 6 | 276 | 132 | 129 | 122 | 67% | 38% |
| 7* | 284 | 157 | 145 | 141 | 93% | 0% |
| 8 | 276 | 106 | 105 | 102 | 40% | 75% |
| 9 | 273 | 85 | 82 | 82 | 12% | 81% |
| 10 | 274 | 97 | 96 | 95 | 30% | 88% |

TABLE 4-continued

| Alloy | Initial Hardness HV | Hardness HV after 60 s | Hardness HV after 180 s | Hardness HV after 300 s | Residual Hardness HV (300 s) in comparison to alloy 12 | Reduction of hardness drop from 60 to 300 s compared to alloy 12 |
|---|---|---|---|---|---|---|
| 11 | 279 | 122 | 119 | 116 | 59% | 63% |
| 12 | 275 | 89 | 80 | 73 | 0% | 0% |

(*Alloy according to the invention)

It appears that by adding iron a good gain in the residual hardness can be achieved, but the reduction of the drop in hardness at extended holding times at temperature, is, however, caused particularly favorably with the additions of titanium.

In addition to the above-described examinations, band sections were heat-treated in a protective-gas atmosphere as follows:

twelve-minute annealing of the bands in a forming gas (95% $N_2$, 5% $H_2$) at 700° C., furnace cooling to 200° C., cooling to room temperature in ambient air.

The soldering process under protective gas is proven with this experiment, with the difference that fluctuations through the manufacturing process are excluded. The evaluation of the experiment includes the judging of the bands with respect to their surface discoloration and their structure. The following table shows that the initial behavior of the alloys of the present invention can be compared with the common phosphor bronzes. In the case of high Fe-content, the discoloration is even less than in the common CuSn-alloys. A protective after-treatment of the surfaces near the solder seam is in this case only needed to a reduced degree or not at all.

TABLE 5

| Alloy | Change in surface color after the described treatment in comparison to the non-annealed initial state |
|---|---|
| 1 | distinct discoloration |
| 2 | distinct discoloration |
| 3 | slight discoloration |
| 4* | slight discoloration |
| 5* | slight discoloration |
| 6 | distinct discoloration |
| 7* | slight discoloration |
| 8 | distinct discoloration (flaking layer of scale) |
| 9 | very strong discoloration |
| 10 | very strong discoloration |
| 11 | very strong discoloration |
| 12 | distinct discoloration |

The microstructure of the alloys of the invention is to be characterized according to the abovementioned heat treatment as follows. The structure is free of oxides even though, as this is generally viewed according to the state of the art as necessary, phosphorus was not alloyed therewith. Precipitations can only be proven, in which the inventive alloy elements Fe or Ti are strengthened. The medium grain sizes, in the inventive alloys after the above heat treatment, are only approximately 25 μm. This is due to the grain-refining action of the Fe. If desired, it is also possible to form the alloys of the invention after the joining step without the roughness that would be created on the surface of the structural part, as this is known from the tin-bronze-alloys according to the state of the art.

The following summary results for the total evaluation of the tested alloys.

TABLE 6

| Alloy | Structure in WEZ and Base metal | Quality Hard soldering | Residual hardness HV (300 s) in comparison to alloy 12 | Reduction of the drop in hardness from 60 to 300 s compared to alloy 12 | Discoloration of the surface after heat treatment in a protective gas atmosphere | Relative total suitability compared to alloy 12 |
|---|---|---|---|---|---|---|
| 1 | Okay (= 100%) | moderate (= 50%) | 8% | 75% | distinct (50%) | 33% |
| 2 | Okay (= 100%) | good (= 100%) | 8% | 31% | distinct (50%) | 39% |
| 3 | Okay (= 100%) | good (= 100%) | 48% | 38% | weak (100%) | 136% |
| 4* | Okay (= 100%) | good (= 100%) | 47% | 69% | weak (100%) | 166% |
| 5* | Okay (= 100%) | good (= 100%) | 60% | 63% | weak (100%) | 173% |
| 6 | coarse particles over 10 $\mu$m (= 0%) | not useable (= 0%) | 67% | 38% | distinct (50%) | not useable |
| 7* | Okay (= 100%) | good (= 100%) | 93% | 0% | weak (100%) | 143% |
| 8 | Okay (= 100%) | moderate (= 50%) | 40% | 75% | distinct (100%) | 115% |
| 9 | Okay (= 100%) | not useable (0%) | 12% | 81% | strong (0%) | not useable |
| 10 | Okay (= 100%) | not useable (0%) | 30% | 88% | strong (0%) | not useable |
| 11 | Okay (= 100%) | not useable (0%) | 59% | 63% | strong (0%) | not useable |
| 12 | Okay (= 100%) | good (= 100%) | 0% | 0% | distinct (50%) | 0% |

(*Alloy according to the invention)

It becomes clear that a high added gain in the total suitability is achieved with the alloys of the invention. The added gain is measured in percentage points relative to comparison alloy 12, which is a common phosphorus bronze. It is obvious that the set purpose is attained in a superior manner with the alloys of the invention.

EXAMPLE 2

The alloys were manufactured according to the following process steps into metal strips having a 1 mm thickness.

Permanent mold castings of blocks

Homogenization at 700° C./6 h,

Hot rolling at 760° C. of the overmilled cast blocks with a reduction in cross section of 45%.

Cold rolling of the overmilled hot-rolled strips with a change in cross section of 50% based on the cross section of the overmilled hot-rolled strips Annealing treatment at 500° C./4 h, Finish rolling to 1 mm with a change in cross section of 75% based on the cross section according to the first cold working.

The compositions of the strips are shown below:

TABLE 7

| Alloy | Cu/% | Sn/% | Fe/% | P/% | Al/% |
|---|---|---|---|---|---|
| 1* | 91.11 | 8.55 | 0.30 | | |
| 2* | 91.08 | 8.22 | 0.66 | | |

TABLE 7-continued

| Alloy | Cu/% | Sn/% | Fe/% | P/% | Al/% |
|---|---|---|---|---|---|
| 3* | 90.36 | 8.58 | 1.03 | | |
| 4* | 89.44 | 8.62 | 1.90 | | |
| 5 | 90.87 | 8.61 | 0.31 | 0.1724 | |
| 6* | 91.07 | 8.16 | 0.65 | 0.0765 | |
| 7* | 90.57 | 8.53 | 0.67 | 0.1879 | |
| 8* | 91.06 | 7.97 | 0.64 | 0.286 | |
| 9 | 91.09 | 8.58 | | | 0.2862 |
| 10 | 90.89 | 8.49 | 0.31 | | 0.2739 |
| 11 | 90.02 | 8.61 | 1.04 | | 0.2821 |
| 12 | 91.90 | 8.06 | | 0.024 | |

(*Alloy according to the invention; difference to 100%; each unavoidable contaminants)

The results of the drawing tests, which were carried out on the finish-rolled strips, are shown in the following table.

TABLE 8

| Alloy | $R_{p0,2}$/Mpa | $R_m$/Mpa | $R_{p0,2}/R_m$ | $A_{10}$/% |
|---|---|---|---|---|
| 1* | 882 | 907 | 0.97 | 2.6 |
| 2* | 837 | 895 | 0.94 | 2.3 |
| 3* | 860 | 901 | 0.95 | 3.7 |
| 4* | 930 | 959 | 0.97 | 2.6 |
| 5 | 923 | 953 | 0.97 | 3.3 |
| 6* | 839 | 920 | 0.91 | 2.7 |
| 7* | 867 | 932 | 0.93 | 1.7 |
| 8* | 917 | 935 | 0.98 | 1.9 |

TABLE 8-continued

| Alloy | $R_{p0,2}$/Mpa | $R_m$/Mpa | $R_{p0,2}/R_m$ | $A_{10}$/% |
|---|---|---|---|---|
| 9 | 873 | 906 | 0.96 | 3.8 |
| 10 | 874 | 912 | 0.96 | 3.5 |
| 11 | 888 | 919 | 0.97 | 2.3 |
| 12 | 828 | 895 | 0.93 | 2.4 |

The measured values for the breaking tension $A_{10}$ and the stretch-limit ratio $R_{p0,2}/R_m$ which were found in the alloys of the invention, well agree with the respective values, which one obtains with the corresponding processing steps for the alloy 12 deoxidized with P. Since one may conclude from the amount of the breaking tension the effectiveness of the deoxidation, one can gather that Fe and Ti positively influence the creative forming and reforming of CuSn-alloys in the same manner as P.

To characterize the soldering behavior, 2 band strips of the same alloy were hard-soldered after their surfaces were degreased and mechanically cleaned. A commercially available silver solder was used with an operating temperature of 710° C. Soldering took place under a protective gas without the aid of a fluxing agent. The result of the soldering was evaluated both through a mechanical torsion test and also through a metallographic expert opinion. The strength of the joined materials in the direct vicinity of the soldering gap—thus in the heat-influence zone (WEZ)—was characterized by the Vickers-Hardness HV. The following table gives information about the obtained results.

TABLE 9

| Alloy | Hardness HV Base Material | Lowest Hardness in WEZ after hard soldering | Structure in WEZ and Base Material | Quality Hard Soldering |
|---|---|---|---|---|
| 1* | 273 | 95 | Okay | good |
| 2* | 267 | 111 | Okay | good |
| 3* | 274 | 127 | Okay | good |
| 4* | 278 | 143 | Okay | good |
| 5 | 276 | 112 | Okay | moderate |
| 6* | 266 | 105 | Okay | good |
| 7* | 273 | 118 | Okay | good |
| 8* | 272 | 121 | Okay | good |
| 9 | 273 | 87 | Okay | not useable |
| 10 | 274 | 103 | Okay | not useable |
| 11 | 279 | 121 | Okay | not useable |
| 12 | 275 | 81 | Okay | good |

(*Alloy of the invention; WEZ: Heat-Influence Zone)

The results prove the extremely favorable effect of iron on the residual hardness after the soldering.

To check the material softening during soldering, sections of the cold-formed band sections were annealed at 700° C. up to 5 min. in a salt bath and the residual hardness HV was measured after various times t to obtain the isothermal softening characteristic HV(t) of the analyzed material. The course of hardness over time is important for judging the strength after soldering and the safety in the industrial manufacture of joined structural parts. The higher the residual hardness HV (300 s) after a five-minute annealing treatment, the higher is the to be expected mechanical stability of the soldered connection. The smaller the change in the hardness over time, the more even is the quality of the joined structural parts, and the more robust is the manufacturing process against unavoidable fluctuations of the process parameters. Thus what was evaluated was on the one hand the height of the residual hardness of the alloy Y (Y=1.2 . . . 12) after a five-minute annealing treatment in relationship to the common phosphorus bronze alloy 12: HV(Y, 700° C., 300 s)/HV(12, 700° C., 300 s)−1. On the other hand, the alloys Y were compared with the alloy 12 with respect to the reduction of the difference between the hardness after 60 s and 300 s: 1−[HV(Y, 700° C., 60 s)−HV(Y, 700° C., 300 s)]/[HV(12, 700° C., 60 s)−HV(12, 700° C., 300 s)]. Good materials by comparison show particularly good, positive values for both evaluations.

TABLE 10

| Alloy | Initial Hardness HV | Hardness HV after 60 s | Hardness HV after 180 s | Hardness HV after 300 s | Residual HV (300 s) in comparison to alloy 12 | Reduction of hardness drop from 60 to 300 s compared to alloy 12 |
|---|---|---|---|---|---|---|
| 1* | 273 | 90 | 79 | 79 | 8% | 31% |
| 2* | 267 | 118 | 108 | 108 | 48% | 38% |
| 3* | 274 | 120 | 119 | 111 | 52% | 44% |
| 4* | 278 | 135 | 133 | 128 | 75% | 56% |
| 5 | 276 | 106 | 105 | 102 | 40% | 75% |
| 6* | 266 | 104 | 102 | 100 | 37% | 75% |
| 7* | 273 | 114 | 113 | 110 | 51% | 75% |
| 8* | 272 | 113 | 111 | 111 | 52% | 88% |
| 9 | 273 | 85 | 82 | 82 | 12% | 81% |
| 10 | 274 | 97 | 96 | 95 | 30% | 88% |
| 11 | 279 | 122 | 119 | 116 | 59% | 63% |
| 12 | 275 | 89 | 80 | 73 | 0% | 0% |

(*Alloy according to the invention)

It appears that by adding iron a good gain in the residual hardness can be achieved.

In addition to the above-described examinations, band sections were heat-treated in a protective-gas atmosphere as follows:

twelve-minute annealing of the bands in a forming gas (95% $N_2$, 5% $H_2$) at 700° C., furnace cooling to 200° C., cooling to room temperature in ambient air.

The soldering process under protective gas is proven with this experiment, with the difference that fluctuations through the manufacturing process are excluded. The evaluation of the experiment includes the judging of the bands with respect to their surface discoloration and their structure. The following table shows that the initial behavior of the alloys of the present invention can be compared with the common phosphor bronzes. In the case of high Fe-content, the discoloration is even less than in the common CuSn-alloys. A protective after-treatment of the surfaces near the solder seam is in this case only needed to a reduced degree or not at all.

TABLE 11

| Alloy | Change in surface color after the described heat treatment in comparison to the non-annealed initial state |
|---|---|
| 1* | distinct discoloration |
| 2* | slight discoloration |
| 3* | slight discoloration |
| 4* | slight discoloration |
| 5 | distinct discoloration (flaking layer of scale) |
| 6* | slight discoloration |

TABLE 11-continued

| Alloy | Change in surface color after the described heat treatment in comparison to the non-annealed initial state |
|---|---|
| 7* | slight discoloration |
| 8* | slight discoloration |
| 9 | very strong discoloration |
| 10 | very strong discoloration |
| 11 | very strong discoloration |
| 12 | distinct discoloration |

The microstructure of the alloys of the invention is to be characterized according to the abovementioned heat treatment as follows. The structure is free of oxides even though, as this is generally viewed according to the state of the art as necessary, phosphorus was not alloyed therewith. Precipitations can only be proven, in which the inventive alloy elements Fe or Ti are strengthened. The medium grain sizes, in the inventive alloys after the above heat treatment, are only approximately 25 $\mu$m. This is due to the grain-refining action of the Fe. If desired, it is also possible to form the alloys of the invention after the joining step without the roughness that would be created on the surface of the structural part, as this is known from the tin-bronze-alloys according to the state of the art.

The following summary results for the total evaluation of the tested alloys:

It becomes clear that a high added gain in the total suitability is achieved with the alloys of the invention. The added gain is measured in percentage points relative to comparison alloy 12, which is a common phosphorus bronze. It is obvious that the set purpose is attained in a superior manner with the alloys of the invention.

EXAMPLE 3

An embodiment of the invention can be illustrated with the following example. The alloys were manufactured according to the following process steps into metal strips having a 0.4 mm thickness.

Creating forming of blocks through spray compacting (as a comparison a block of a common phosphorus-bronze with 8% Sn was in addition created through permanent mold casting and was thereafter homogenized at 700° C./6 h, this block was processed with the spray-compacted preforms), Separating of 10 mm thick strips through sawing and milling, Hot rolling of the overmilled cast blocks at 680° C. (CuSn8P at 760° C.) with a reduction in cross section of 70%, Cold rolling of the cleaned hot-rolled strips with a change in cross section of 40% with respect to the cross section of the hot-rolled strips, Annealing treatment at 600° C./3 h, Cold rolling of the soft bands with a change in cross section of 45% with respect to the cross section after the first cold forming,

TABLE 12

| Alloy | Structure in WEZ and Base metal | Quality Hard soldering | Residual hardness HV (300 s) in comparison to alloy 12 | Reduction of the drop in hardness from 60 to 300 s compared to alloy 12 | Discoloration of the surface after heat treatment in a protective gas atmosphere | Relative total suitability compared to alloy 12 |
|---|---|---|---|---|---|---|
| 1* | Okay (= 100%) | good (= 100%) | 8% | 31% | distinct (50%) | 39% |
| 2* | Okay (= 100%) | good (= 100%) | 48% | 38% | weak (100%) | 136% |
| 3* | Okay (= 100%) | good (= 100%) | 52% | 44% | weak (100%) | 146% |
| 4* | Okay (= 100%) | good (= 100%) | 75% | 56% | weak (100%) | 181% |
| 5 | Okay (= 100%) | moderate (= 50%) | 40% | 75% | distinct (100%) | 115% |
| 6* | Okay (= 100%) | good (= 100%) | 37% | 75% | weak (100%) | 162% |
| 7* | Okay (= 100%) | good (= 100%) | 51% | 75% | weak (100%) | 176% |
| 8* | Okay (= 100%) | good (= 100%) | 52% | 88% | weak (100%) | 190% |
| 9 | Okay (= 100%) | not useable (0%) | 12% | 81% | strong (0%) | not useable |
| 10 | Okay (= 100%) | not useable (0%) | 30% | 88% | strong (0%) | not useable |
| 11 | Okay (= 100%) | not useable (0%) | 59% | 63% | strong (0%) | not useable |
| 12 | Okay (= 100%) | good (= 100%) | 0% | 0% | distinct (50%) | 0% |

(*Alloy according to the invention)

Annealing treatment at 600° C./3 h,

Finish rolling over 0.8 mm and 0.6 mm on 0.4 mm with a change in cross section of ultimately 60% with respect to the cross section after the second cold forming.

The compositions of the strips are assembled hereinafter:

TABLE 13

| Alloy | Cu/% | Sn/% | Fe/% | P/% |
|---|---|---|---|---|
| A | 84.03 | 15.24 | 0.73 | |
| B | 84.69 | 15.00 | 0.31 | |
| CuSn8P | 91.88 | 7.95 | | 0.17 |

(Alloy A and B according to the invention)

The mechanical characteristic values of the strips after the last heat treatment or after the finish rolling are shown in the following table:

TABLE 14

| State | soft (1 mm) | rolled hard (0.8 mm) | rolled hard (0.6 mm) | rolled hard (0.4 mm) |
|---|---|---|---|---|
| Alloy A | | | | |
| $R_{p0,2}$/MPa | 280 | 602 | 709 | 894 |
| $R_m$/MPa | 570 | 798 | 865 | 986 |
| $R_{p0,2}/R_m$ | 0.49 | 0.75 | 0.82 | 0.91 |
| HV | 140 | 231 | 265 | 280 |
| $A_{10}$/% | 53 | 21 | 6 | 2 |
| Alloy B | | | | |
| $R_{p0,2}$/MPa | 255 | 559 | 722 | 884 |
| $R_m$/MPa | 555 | 773 | 868 | 958 |
| $R_{p0,2}/R_m$ | 0.46 | 0.73 | 0.83 | 0.92 |
| HV | 134 | 221 | 263 | 275 |
| $A_{10}$/% | 56 | 23 | 6 | 2 |
| CuSn8P | | | | |
| $R_{p0,2}$/MPa | 205 | 495 | 689 | 836 |
| $R_m$/MPa | 420 | 578 | 732 | 872 |
| $R_{p0,2}/R_m$ | 0.49 | 0.86 | 0.94 | 0.96 |
| HV | 85 | 173 | 220 | 252 |
| $A_{10}$/% | 61 | 25 | 7 | 2 |

The alloys A and B of the invention differ from the alloy of conventional phosphorus-bronze in its higher strength values. Nevertheless the measured values for the breaking tension $A_{10}$ and the stretch-limit ratio $R_{p0,2}/R_m$, which were found in the alloys of the invention, well agree with the respective values, which one obtains with the corresponding processing steps for the alloy CuSn8P deoxidized with P. Since one may conclude from the amount of the breaking tension the effectiveness of the deoxidation, one can gather from this agreement that Fe positively influences the original forming and reforming of the CuSn-alloys in the same manner as P.

To characterize the soldering behavior, two hard rolled, 1 mm thick band strips of the same alloy were each hard-soldered after their surfaces were degreased and mechanically cleaned. A commercially available silver solder with an operating temperature of 710° C. was used. Soldering took place under a protective gas without the aid of a fluxing agent. The result of the soldering was evaluated both through a mechanical torsion test and also through a metallographic expert opinion. The strength of the joined materials in the direct vicinity of the soldering gap—thus in the heat-influence zone (WEZ)—was characterized by the Vickers-Hardness HV. The following table gives the obtained results.

TABLE 15

| Alloy | Hardness HV of Base material | Lowest Hardness in WEZ after hard soldering | Structure in WEZ and Base material | Quality Hard soldering |
|---|---|---|---|---|
| A | 270 | 159 | Okay | good |
| B | 265 | 148 | Okay | good |
| CuSn8P | 240 | 78 | Okay | good |

(Alloy A and B according to the invention; WEZ: Heat-Influence Zone)

The results prove the extremely favorable effect of tin and iron additions to the residual hardness of a CuSn-alloy after the soldering.

To check the material softening during the soldering, sections of the cold-formed band sections were annealed at 700° C. up to 5 min. in a salt bath and the residual hardness HV was measured after various times t to obtain the isothermal softening characteristic HV(t) of the analyzed material. The course of hardness over time is important for judging the strength after soldering and safety in the industrial manufacture of joined structural parts. The higher the residual hardness HV (300 s) after a five-minute annealing treatment, the higher the expected mechanical stability of the soldered connection, the lesser the change in the hardness over time, the more even is the quality of the joined structural parts, and the more robust is the manufacturing process against unavoidable fluctuations of the process parameters. Thus, what was evaluated was on the one hand the height of the residual hardness of the alloy A or B after a five-minute annealing treatment in relationship to the common phosphorus bronze alloy: HV(alloy A or B, 700° C., 300 s). −1. On the other hand, the alloys A and B were compared with the alloy CuSn8P with respect to the reduction of the difference between the hardness after 60 s and 300 s: 1−[HV(Alloy A or B, 700° C., 60 s)−HV(Alloy A or B, 700° C., 300 s)]/[HV(CuSnP, 700° C., 60 s)−HV(CuSnP, 700° C., 300 s)]. Good materials by comparison show particularly good, positive values for both evaluations.

TABLE 16

| Alloy | Initial Hardness HV | Hardness HV after 60 s | Hardness HV after 180 s | Hardness HV after 300 s | Residual hardness HV (300 s) in comparison to CuSn8P | Reduction in hardness drop from 60 to 300 s compared to CuSn8P |
|---|---|---|---|---|---|---|
| A | 270 | 145 | 141 | 140 | 92% | 69% |
| B | 265 | 138 | 135 | 134 | 85% | 75% |
| CuSn8P | 240 | 89 | 78 | 73 | 0% | 0% |

(Alloy A, B: according to the invention)

It is shown that by increasing the Sn-content in connection with additions of iron, a good gain can be achieved in the residual hardness.

In addition to the above-described examinations, band sections were heat-treated in a protective-gas atmosphere as follows: twelve-minute annealing of the bands in forming gas (95% $N_2$, 5% $H_2$) at 700° C., furnace cooling to 200° C., cooling to room temperature in ambient laboratory air.

The soldering process under protective gas is proven with this experiment, with the difference that fluctuations through the manufacturing process are excluded. The evaluation of the experiment includes the judging of the bands with respect to their surface discoloration and their structure. The following table shows that the initial behavior of the alloys of the present invention can be compared with the common phosphor bronzes. In the case of high Fe-content, the discoloration is even less than in the common CuSn-alloys. A protective after-treatment of the surfaces near the solder seam is in this case only needed to a reduced degree or not at all.

TABLE 17

| Alloy | Change in surface color after the described heat treatment in comparison to the non-annealed initial state |
|---|---|
| A | weak discoloration |
| B | weak discoloration |
| CuSn8P | distinct discoloration |

The microstructure of the alloys of the invention is characterized according to the above-mentioned heat treatment as follows. A precipitation-poor structure exists, which is free of oxides, even though, as this is generally viewed according to the state of the art as necessary, phosphorus was not alloyed therewith. Precipitations can only be proven, in which the inventive alloy elements Feor Sn are strengthened. The medium grain sizes in the inventive alloys after the above heat treatment are only approximately 25 $\mu$m. This is due to the grain-refining action of the Fe. If desired, it is also possible to reform the alloys of the invention after joining without roughness being created on the surface of the structural part, as this is known from the tin-bronze-alloys according to the state of the art.

The following summary results from the total evaluation of the tested alloys:

TABLE 18

| Alloy | Structure in WEZ and Base metal | Quality Hard soldering | Residual hardness HV (300 s) in comparison to CuSn8P | Reduction of the drop in hardness from 60 to 300 s compared to alloy CuSn8P | Discoloration of the surface after heat treatment in a protective gas atmosphere | Relative total suitability compared to CuSn8P |
|---|---|---|---|---|---|---|
| A | Okay (= 100%) | good (= 100%) | 92% | 69% | weak (100%) | 211% |
| B | Okay (= 100%) | good (= 100%) | 85% | 75% | weak (100%) | 210% |
| CuSn8P | Okay (= 100%) | good (= 100%) | 0% | 0% | distinct (50%) | 0% |

(Alloy A, B: according to the invention)

It becomes clear that a high added gain in total suitability is achieved with the alloys of the invention. The added gain is measured in percentage points relative to the common phosphorus bronze CuSn8P. It is obvious that the set purpose is attained in a superior manner with the inventive use of the suggested alloys.

EXAMPLE 4

Sliding stress between material pairings occur under very high surface pressures in worm gearings and also in highly stressed glide elements. Demanded are materials with a very high strength and sufficient tribological characteristics. The inventive CuSnFe alloy is particularly suited for these uses.

In order to produce a semifinished product suited for manufacturing a worm gear, a bolt CuSn15Fe 0.8 was manufactured through spray compacting. Nitrogen was used as the spray gas. The phenomena typical for alloys deoxidized by suitable additions, namely slag formation, the burning off and the increase of the viscosity of the melt based on the oxide formation were completely avoided in the alloy of the invention in spite of atmospheric melt conditions. What was found was a slight Fe-burn-off of 0.85% by weight to 0.75% by weight in the sprayed bolt, which, however, was of no significance for the manufacture and the function of the structural part.

The structure in the sprayed state was evenly and metallographically free of precipitations. After a chipping machining of the bolt, a hot forming occurred through extrusion to form a rod with a diameter of 20 mm. The temperature of the material was thereby 650° C. The rod material was dressed.

The material existed after the hot forming in a soft state. The mechanical characteristics were determined in $A_{10}$= 53%, $R_{p0,2}$=253 MPa, $R_m$=548 MPa, HV−133.

The rods were dressed for the surface leveling. Further working occurred through a cold-drawing process in order to increase the strength characteristics. The forming was carried out in two steps. In the first forming step, the rods were drawn to a diameter of 17.9 mm, corresponding to a surface reduction of 20% ($\psi$=0.22). The second forming step occurred without intermediate annealing at the diameter 15.5 mm. The entire forming corresponds thus to a surface reduction of 40% ($\psi$=0.51). The rods were subsequently dressed.

In order to avoid a workpiece distortion during the chipping operation, inner tensions were reduced by a 4-hour annealing treatment at 300° C. The rod material shows at the end of the treatment the following characteristics: $A_{10}$= 5.8%, $R_{p0,2}$=709 MPa, $R_m$=865 MPa, HV10=265.

The following table compares the achieved characteristics with the CuSn15.5-alloy, which, but for the melting, were processed in the same manner. The melting process occurred in each alloy in a vacuum so that deoxidizing additions were not needed. The process-technical input of the manufacture of the CuSn15.5-material was thus significantly higher than the manufacturing input of CuSn15.5Fe0.7.

As a comparison, the stretch limit $R_{p0,2}$ of a conventionally manufactured CuSn-wrought alloy with 8% by weight Sn is after a cold forming with 40% surface reduction approximately 620 MPa.

TABLE 19

| | |
|---|---|
| CuSn15.5Fe0.7 after cold-forming with 40% surface reduction | $R_m$ = 865 MPa, $R_{p0,2}$ = 709 MPa, $A_{10}$ = 5.8%, HV10 = 265 |
| CuSn15.5 after cold-forming with 40% surface reduction | $R_m$ = 828 MPa, $R_{p0,2}$ = 681 MPa, $A_{10}$ = 6.7%, HV10 = 250 |

(CuSn15.5Fe0.7: according to the invention)

By using 0.7% by weight Fe, the alloy of the invention clearly achieves better mechanical characteristics than the Fe-free variation and is thus also better suited for mechanically stressed structural parts than the conventional tin-poor CuSn-wrought alloys. The ductility characteristic values are similar in both materials, from which follows that the Fe-additions are suited to make the creation of pores and brittling oxide lines during the original forming more difficult. This was not expected because this effect of the iron in a CuSn-alloy was up to now not known.

An annealing treatment at 650° C. results in softening of the materials. After 3 h annealing time the characteristics listed in the table below showed up:

TABLE 20

| | |
|---|---|
| CuSn15.5Fe0.7 after cold-forming with 40% surface reduction and sub-annealing 650° C./3 h. | $R_m$ = 548 MPa, $R_{p0,2}$ = 253 MPa, $A_{10}$ = 50%, HV10 = 133 |
| CuSn15.5 after cold-forming with 40% surface reduction and sub-annealing 650° C./3 h. | $R_m$ = 498 MPa, $R_{p0,2}$ = 182 MPa, $A_{10}$ = 50 HV10 = 104 |

(CuSn15.5Fe0.7: according to the invention)

Noticeable is the very slight softening of the alloys of the invention. The characteristic magnitudes of the strength clearly exceed the ones of a conventional originally formed tin bronze with 8% by weight Sn, which was formed and heat-treated in a comparable manner. This leads to the conclusion that the tin-rich alloys have significantly better mechanical characteristics at high temperatures, that is, resistance to softening, resistance to relaxation, creep strength or time strength, than the common CuSn-wrought alloys. Thus the alloy of the invention is also suited for use at an elevated temperature.

In a direct comparison of the tin-rich, spray-compacted materials, the Fe-containing alloy reaches after the heat treatment higher strength values, which is an indication for a higher comparative stability of the mechanical characteristics.

A CuSn8-alloy, after cold forming with 40% surface reduction and following heat treatment, typically has the following mechanical characteristic magnitudes: $A_{10}$=60%, $R_{p0,2}$=80 MPa, $R_m$=350 MPa, HV=75.

With these results it can be shown that the process-technical input for the manufacture of tin-rich CuSn-alloys can be avoided through an increased Fe-content, and an improvement in the materials can be achieved.

What is claimed is:

1. A copper alloy consisting of 4–12 wt. % tin, 0.1–4 wt. % in total of at least one of iron and cobalt, 0.01–0.6 wt. % in total of at least one of titanium and hafnium, and the balance being copper.

2. A method of manufacturing structural metal parts which are joined together through the use of heat, in which the improvement comprises at least one of the structural parts being made of a wrought copper alloy consisting of 12–20 wt. % tin, 0.1–4 wt. % in total of at least one of iron and cobalt and the balance being copper.

3. Structural metal parts joined together through the use of heat, in which the improvement comprises at least one of the structural metal parts being made of a wrought copper alloy consisting of 12–20 wt. % tin, 0.1–4 wt. % in total of at least one of iron and cobalt and the balance being copper.

4. The structure metal parts according to claim 3, wherein said metal parts are jewelry or clothing accessories.

5. The structural metal parts according to claim 3, wherein said metal parts are used in the manufacture of eyeglass frames.

6. The copper alloy of claim 1, wherein the weight ratio of iron to titanium is at least 2.5.

7. The copper alloy of claim 1, wherein said alloy comprises 6–10 wt. % tin, 0.5–2.5 wt. % iron and 0.05–0.4 wt. % titanium.

8. The copper alloy of claim 1, wherein said alloy comprises 7–9 wt. % tin, 1–2 wt. % iron and 0.05–0.3 wt. % titanium.

9. The copper alloy of claim 1, wherein said alloy comprises 10–12 wt. % tin, 2.5–4 wt. % iron and 0.1 to 0.5 wt. % titanium.

10. The copper alloy of claim 1, wherein iron cobalt are both present in the alloy.

11. The copper alloy of claim 1, wherein titanium and hafnium are both present in the alloy.

12. In a method of manufacturing structural parts which are joined together through the use of heat, the improvement comprising at least one of the structural parts being made of the copper alloy of claim 1.

13. The method of claim 12, wherein the structural parts are joined by soldering at a temperature greater than 300° C.

14. The method of claim 12, wherein the structural parts are joined by press welding or fusion welding.

15. The method of claim 12, wherein the structural parts are jewelry or clothing accessories.

16. The method of claim 12, wherein the structural parts are used in the manufacture of eyeglass frames.

17. The method of claim 2, wherein the alloy comprises 12 to 20 wt. % tin and 0.4–4 wt. % iron.

18. The method of claim 17, wherein the structural parts are joined by soldering at a temperature greater than 300° C.

19. The method of claim 17, wherein the structural parts are joined by press welding or fusion welding.

20. The method of claim 17, wherein the structural parts are jewelry or clothing accessories.

21. The method of claim 17, wherein the structural parts are used in the manufacture of eyeglass frames.

22. The method of claim 17, wherein the alloy comprises 13–16 wt. % tin and 0.5 to 2.5 wt. % iron.

23. The method of claim 17, wherein the alloy comprises 12–15 wt. % tin and 1–4 wt. % iron.

24. The method of claim 17, wherein the alloy comprises 15–20 wt. % tin and 1.5–4 wt. % iron.

25. The method of claim 17, wherein iron and cobalt are both present in the alloy.

* * * * *

UNITED STATES PATENT AND TRADEMARK OFFICE

CERTIFICATE OF CORRECTION

PATENT NO. : 6,346,215 B1
DATED : February 12, 2002
INVENTOR(S) : Andreas Boegel et al.

It is certified that error appears in the above-identified patent and that said Letters Patent is hereby corrected as shown below:

Column 20,
Line 30, change "iron cobalt" to -- iron and cobalt --.
Line 47, change "0.4-4 wt. %" to -- 0.1-4 wt. % --.

Signed and Sealed this

Twenty-fourth Day of September, 2002

*Attest:*

*Attesting Officer*

JAMES E. ROGAN
*Director of the United States Patent and Trademark Office*